US010569596B2

(12) United States Patent
Ikai et al.

(10) Patent No.: US 10,569,596 B2
(45) Date of Patent: Feb. 25, 2020

(54) WRITING TOOL REFILL AND WRITING TOOL USING SAME

(71) Applicant: MITSUBISHI PENCIL COMPANY, LIMITED, Tokyo (JP)

(72) Inventors: Takayuki Ikai, Yokohama (JP); Seiichi Takigawa, Yokohama (JP); Naohiro Katou, Yokohama (JP); Takanori Shindou, Yokohama (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 3 days.

(21) Appl. No.: 15/752,689

(22) PCT Filed: Oct. 6, 2016

(86) PCT No.: PCT/JP2016/079851
§ 371 (c)(1),
(2) Date: Feb. 14, 2018

(87) PCT Pub. No.: WO2017/061570
PCT Pub. Date: Apr. 13, 2017

(65) Prior Publication Data

US 2018/0236807 A1 Aug. 23, 2018

(30) Foreign Application Priority Data

Oct. 9, 2015 (JP) ..... 2015-201375

(51) Int. Cl.
*B43K 7/06* (2006.01)
*B43K 7/02* (2006.01)
(Continued)

(52) U.S. Cl.
CPC ..... *B43K 7/06* (2013.01); *B43K 7/02* (2013.01); *B43K 7/12* (2013.01); *B43K 15/02* (2013.01);
(Continued)

(58) Field of Classification Search
CPC . B43K 7/00; B43K 7/005; B43K 7/02; B43K 7/04; B43K 7/06; B43K 7/08;
(Continued)

(56) References Cited

U.S. PATENT DOCUMENTS 2,704,533 A * 3/1955 Spallini ..... B43K 7/00 401/217
5,026,190 A * 6/1991 Longarzo ..... B43K 24/146 401/29
(Continued)

FOREIGN PATENT DOCUMENTS

CN 2111844 U 8/1992
DE 102012107045 A1 2/2014
(Continued)

OTHER PUBLICATIONS

Machine translation of JP2006-175745 retrieved on Apr. 13, 2019 from: http://translationportal.epo.org/emtp/translate/?ACTION=description-retrieval&COUNTRY=JP&ENGINE=google&FORMAT=docdb&KIND=A&LOCALE=en_EP&NUMBER=2006175745&OPS=ops.epo.org/3.2&SRCLANG=ja&TRGLANG=en.*
(Continued)

*Primary Examiner* — Patrick M. Buechner
(74) *Attorney, Agent, or Firm* — Westerman, Hattori, Daniels & Adrian, LLP; John P. Kong

(57) ABSTRACT

A refill for a writing tool includes an ink containing tube that is made from a resin material and formed in a straight cylindrical shape, and a writing tip that is attached to an end of the ink containing tube. A press-fit portion, formed at the end of the ink containing tube, has a thickness being made thickened toward an inner circumferential surface and has an opening hole penetrating in an axial direction at a central portion of the press-fit portion. The writing tip or a relay member supporting the writing tip is press-fitted and attached to the press-fit portion. The refill for a writing tool
(Continued)

can ensure a necessary and sufficient amount of ink stored without expanding an outer diameter of the ink containing tube, and sufficiently secure mechanical strength of an end portion, and a writing tool using the same can be provided.

8 Claims, 6 Drawing Sheets

(51) Int. Cl.

| | |
|---|---|
| ***B43K 15/02*** | (2006.01) |
| ***B43K 7/12*** | (2006.01) |
| ***B43K 24/16*** | (2006.01) |
| ***B43K 27/00*** | (2006.01) |
| ***B43K 27/12*** | (2006.01) |
| *B43K 25/02* | (2006.01) |

(52) U.S. Cl.
CPC ..... *B43K 24/163* (2013.01); *B43K 27/003* (2013.01); *B43K 27/12* (2013.01); *B43K 25/02* (2013.01)

(58) Field of Classification Search
CPC ... B43K 7/12; B43K 8/03; B43K 8/04; B43K 8/12; B43K 27/003; B43K 27/006; B43K 27/12
See application file for complete search history.

(56) References Cited

U.S. PATENT DOCUMENTS

| | | | | |
|---|---|---|---|---|
| 8,292,530 | B2 * | 10/2012 | Tamano | B43K 7/005 401/105 |
| 8,714,856 | B2 * | 5/2014 | Ishii | B43K 1/08 401/209 |
| 2002/0118264 | A1 * | 8/2002 | Fukushima | B43K 5/14 347/86 |
| 2004/0109721 | A1 * | 6/2004 | Nowak | B43K 5/18 401/227 |
| 2004/0213629 | A1 * | 10/2004 | Ando | B43K 1/084 401/214 |
| 2007/0020031 | A1 * | 1/2007 | Ikai | B43K 7/00 401/142 |
| 2015/0298489 | A1 * | 10/2015 | Kamitani | B43K 7/02 401/142 |

FOREIGN PATENT DOCUMENTS

| | | | | |
|---|---|---|---|---|
| FR | 894857 | A | 1/1945 | |
| FR | 65409 | E | 2/1956 | |
| FR | 1159103 | A | 6/1958 | |
| FR | 1415824 | A | 10/1965 | |
| GB | 263341 | A | * 12/1926 | B43K 5/04 |
| GB | 688892 | A | 3/1953 | |
| JP | 7-299987 | A | 11/1995 | |
| JP | 11-321178 | A | 11/1999 | |
| JP | 2002-59682 | A | 2/2002 | |
| JP | 2004-322485 | A | 11/2004 | |
| JP | 2005-313404 | A | 11/2005 | |
| JP | 2006-175745 | A | 7/2006 | |
| JP | 2011-212941 | A | 10/2011 | |
| WO | 2007/112658 | A1 | 10/2007 | |

OTHER PUBLICATIONS

International Search Report dated Jan. 10, 2017, issued in counterpart application No. PCT/JP2016/079851. (2 pages).
Office Action dated Jun. 4, 2019, issued in counterpart JP application No. 2017-544232, with English translation. (8 pages).
Extended (Supplementary) European Search Report dated Apr. 24, 2019, issued in counterpart EP application 16853721.5. (7 pages).

* cited by examiner

WRITING TOOL REFILL AND WRITING TOOL USING SAME

TECHNICAL FIELD

The present invention relates to a refill for a writing tool to be used for a ballpoint pen, for example, and a writing tool using the refill.

BACKGROUND ART

In general, a ballpoint pen tip as a writing portion is press-fitted and attached to one end (front end) of an ink containing tube in a refill for a writing tool to be used for a ballpoint pen or the like.

Further, the ink containing tube is made of a resin material such as polypropylene conventionally in order to achieve ease of molding and visibility of ink amount.

FIG. 14 illustrates an example of a conventional ballpoint pen refill in a cross-sectional view, and the example illustrated in FIG. 14 illustrates a configuration in which a ballpoint pen tip 2 is attached to a front end of an ink containing tube 1 with a joint member 3. Further, an outer peripheral face of the ink containing tube 1 is formed in a cylindrical shape to be flush. An inner diameter of the front end of the ink containing tube 1 to which the joint member 3 is fitted and an inner diameter of an axially central portion of the ink containing tube 1 forming the ink containing tube have substantially the same dimension to form a straight shape.

For example, JP A 2002-59682 (Patent Literature 1) discloses a ballpoint pen refill using such an ink containing tube having a straight inner circumferential surface.

A ballpoint pen refill is proposed in JP A 2006-175745 (Patent Literature 2), for example; the refill is configured such that an outer peripheral surface of an ink containing tube is similarly formed flush in a cylindrical shape and an inner diameter of a front end of the ink containing tube to which a ballpoint pen tip is fitted is bored to be larger than an inner diameter of a central portion of an axial direction forming an ink containing portion.

In the above-described ballpoint pen refills, the front end in particular of the ink containing tube to which the ballpoint pen tip is fitted needs to have a certain thickness to ensure its strength. Consequently, there arises a practical problem that it is difficult to ensure a sufficient amount of ink stored because the front end has the fixed thickness in case of the ballpoint pen refills having the configuration disclosed in Patent Literatures 1 and 2.

A ballpoint pen refill disclosed in the Patent Literature 3 exemplifies a refill for a writing tool that takes into consideration such that a sufficient amount of ink can be stored. According to the ballpoint pen refill described in Patent Literature 3, however, it is necessary to individually prepare an ink containing tube having a size corresponding to the barrel for each model, since an ink containing tube having a fan-shaped cross section orthogonal to the axis is used, which is problematic in terms of versatility.

In addition, it is difficult to impart flexibility to the ink containing tube having a fan-shaped cross section orthogonal to the axis. As a result, when the ink containing tube is used for a composite writing tool that houses plural refills in a barrel, there arises a technical problem where a smooth operation can hardly be expected; that is, it is difficult to operate the ballpoint pen tip to alternately protrude and retract through a distal end opening of the barrel.

CITATION LIST

Patent Literature

Patent Literature 1: JP 2002-59682 A
Patent Literature 2: JP 2006-175745 A
Patent Literature 3: JP H11-321178 A

SUMMARY OF INVENTION

The present invention has been made in view of the above-described problems in the conventional refill for a writing tool. An object thereof is to provide a refill for a writing tool that is capable of ensuring a necessarily sufficient amount of ink stored without expanding an outer diameter of an ink containing tube, and ensuring sufficient mechanical strength of an end of the ink containing tube to which a writing tip (ballpoint pen tip) is attached.

Another issue of the present invention is to provide a refill for a writing tool which enables writing tips to protrude and to retract alternately and smoothly through a distal end opening of a barrel by utilizing its flexibility even in a case plural refills are employed in a barrel of a composite writing tool, and a writing tool using the same.

Solution to Problem

The refill for a writing tool according to the present invention that has been made in order to overcome the above-described difficulties is a refill for a writing tool including: an ink containing tube being formed in a straight cylindrical shape made of a resin material; and a writing tip attached to an end of the ink containing tube. A press-fit portion is formed at the end of the ink containing tube. The thickness of the press-fit portion is formed to be thickened toward the inner circumferential surface and has an opening hole penetrating therethrough in the axial direction at the axial center of the press-fit portion, and the writing tip or with a relay member supporting the writing tip is press-fitted and attached to the press-fit portion.

In this case, it is also possible to preferably adopt a configuration in which the press-fit portion is formed at each of both ends of the ink containing tube.

In addition, an abutment portion in which a shaft hole having a diameter further smaller than the opening hole is formed is formed on the central portion side of the ink containing tube in the press-fit portion according to one preferred aspect.

In addition, it is desirable that the press-fit portion be integrally formed with the ink containing tube.

Further, the above-described refill for a writing tool is suitably used in a writing tool in which a plurality of these refills is housed in a barrel.

Advantageous Effects of Invention

As for the refill for a writing tool having the above-described configuration, the press-fit portion, which is formed to be thickened toward the inner circumferential surface and has the opening hole penetrating therethrough in the axial direction at the central portion thereof, is formed at the end of the ink containing tube formed in the cylindrical shape. As a result, it is possible to attach the writing tip (ballpoint pen tip) by utilizing the press-fit portion with the opening hole.

In this case, since the press-fit portion is formed to be thickened toward the inner circumferential surface, it is possible to sufficiently ensure the mechanical strength of the attachment portion of the writing tip and to set a tube thickness of the ink containing tube relatively thin excluding the press-fit portion. This enables to provide the refill for a writing tool that can ensure a sufficient amount of ink stored.

Further, the above-described effects are obtainable without increasing an outer diameter or the entire length of the ink containing tube according to the refill for a writing tool having the above-described configuration. Consequently, a shaft diameter will not become increased even if the refill for a writing tool is housed in the barrel, and it is possible to suitably use the refill for a writing tool in the composite writing tool which enables each writing tip alternately protrude and retract through the distal end opening of the barrel.

DESCRIPTION OF EMBODIMENTS

Figure 1:
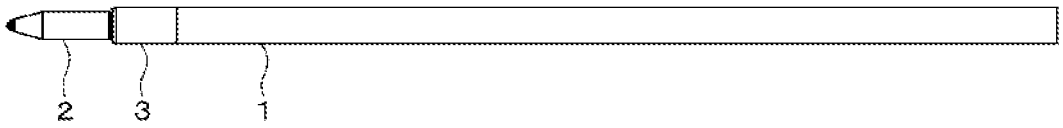
FIG. 1 is an external view illustrating a first aspect of a refill for a writing tool according to the present invention.

A refill for a writing tool and a writing tool according to the present invention will be described based on embodiments shown in the drawings, in which, for examples, a ballpoint pen refill and a composite writing tool containing plural ballpoint pen refills in a barrel are illustrated.

Figure 2:
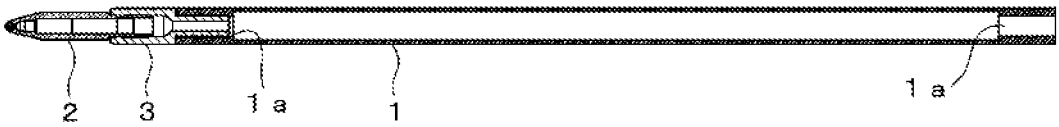
FIG. 2 is a central sectional view of the refill for a writing tool illustrated in FIG. 1.
Figure 3:
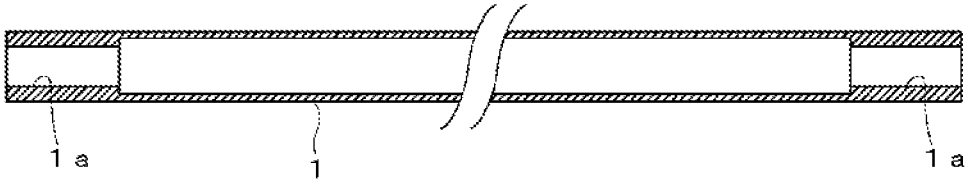
FIG. 3 is an enlarged central sectional view illustrating an ink containing tube, as a single unit, to be used in the refill illustrated in FIG. 1.

First, FIGS. 1 to 3 illustrate a first embodiment of the ballpoint pen refill; a joint member 3 on which a ballpoint pen tip 2 has been mounted in advance is attached press-fittedly to one end (front end) of an ink containing tube 1 made from a resin material, for example, polypropylene.

The ink containing tube 1 is formed into a flush cylindrical shape in an axial direction, and press-fit portions 1*a* each of which is formed to be thickened toward an inner circumferential surface are formed at both ends of the ink containing tube 1 as illustrated in an enlarged view of both the ends in FIG. 3.

The press-fit portion 1*a* is constituted with an opening hole penetrating therethrough in the axial direction at a central portion, formed to be thickened. The joint member 3 is press-fitted by using the thick press-fit portion 1*a*, and the ballpoint pen tip 2 is attached to the front end of the ink containing tube 1 with the joint member 3.

In addition, the ballpoint pen tip 2 may be directly press-fitted and attached to the front end of the ink containing tube 1 without a relay member such as the joint member 3.

Incidentally, each of the thick press-fit portions 1*a* formed at both the ends of the ink containing tube 1 is formed integrally with the ink containing tube 1 in the examples illustrated in FIGS. 1 to 3.

Since the press-fit portion 1*a* formed at the end of the ink containing tube 1 is formed to be thickened toward the inner circumferential surface according to the ballpoint pen refill illustrated in this example, it is possible to sufficiently ensure the mechanical strength of the attachment portion of the ballpoint pen tip 2. The thickness of the press-fit portion 1*a* is preferably 0.5 mm or more.

Figure 14:
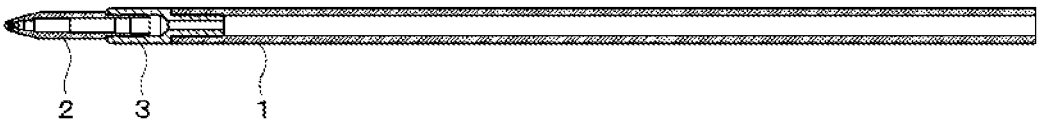
Fig. 14 Prior Art
FIG. 14 is a central cross-sectional view illustrating an example of a conventional refill for a writing tool.

Thus, it is possible to set the tube thickness of the ink containing tube 1 excluding the press-fit portion 1*a* relatively thin as compared with the conventional example illustrated in FIG. 14. The tube thickness can be made less than 0.5 mm, thinner than the thickness of the press-fit portion 1*a*. In particular, the tube thickness is preferably 0.25 mm to 0.45 mm in consideration of the moldability of the press-fit portion 1*a* and the like. As a result, it is possible to provide the ballpoint pen refill capable of sufficiently ensuring the ink storage amount without expanding the outer diameter of the ink containing tube 1. A length A in the axial direction of the press-fit portion 1*a* is preferably 1.5 mm to 5 mm from the viewpoint of ensuring an appropriate press-fitting force and ensuring the ink amount, and then, gripping force of a attaching portion to the ballpoint pen tip 2 or the joint member 3 is preferably 9.8 N or more. As for the strength of the attachment portion, a force required to pull out the ballpoint pen tip 2 or the joint member 3 attached to the press-fit portion 1*a* from the ink containing tube 1 is measured with a commercially available push pull gauge (a force gauge 500N manufactured by IMADA Co., Ltd.)

The outer diameter of the ink containing tube 1 is preferably 2.8 mm to 3.5 mm, which enables use without feeling any difference from the conventional writing tool.

Figure 4B:
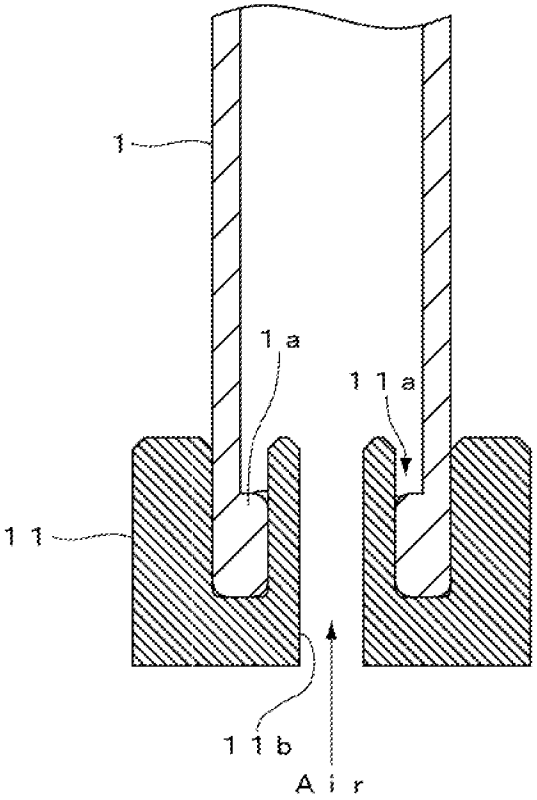
FIG. 4(A) and FIG. 4(B) are schematic views illustrating a first means for forming a thick press-fit portion at an end of the ink containing tube.
Figure 4A:
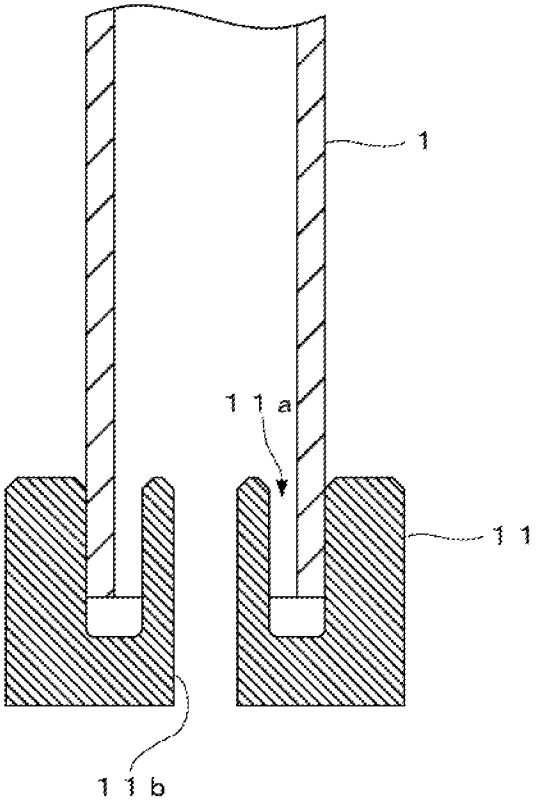

FIG. 4(A) and FIG. 4(B) illustrate a first means for forming the above-described press-fit portion 1*a* at the end of the ink containing tube 1. The method of forming the press-fit portion 1*a* illustrated in FIG. 4(A) and FIG. 4(B) are called an impulse welding (IPW); this uses a welding tip 11 for heating and melting the end of the ink containing tube 1.

That is, an annular recess 11*a* into which the end of the ink containing tube 1 can be inserted is formed in the welding tip 11, and it is configured such that a heating element (not shown) is mounted to the welding tip 11 to make the welding tip 11 heated by, for example, Joule heat. In addition, a gas introduction hole 11*b* is formed in a central portion of the welding tip 11, and it is configured such that a cooling gas (air) can be introduced through this gas introduction hole 11*b*.

FIG. 4(A) illustrates a state where the end of the ink containing tube 1 is inserted into the annular recess 11*a* of the welding tip 11. In this state, the welding tip 11 is heated, and accordingly, the end of the ink containing tube 1 made of resin material is softened and melted. As illustrated in FIG. 4(B), the thick press-fit portion 1*a* is formed toward the inner circumferential surface at the end of the ink containing tube 1 along the annular recess 11*a* of the welding tip 11 by softening and melting the end of the ink containing tube 1.

In this state, heating of the welding tip 11 is stopped; the end of the ink containing tube 1 is cooled by feeding the cooling air into the through hole 11*b* in the direction indicated by the arrow. Then, the thick press-fit portion 1*a* is formed at the end of the ink containing tube 1, and is released from the welding tip 11.

It is possible to obtain the ink containing tube 1 at both end of which the thick press-fit portions 1*a* are integrally formed by performing the same process to the other end of the ink containing tube 1 as necessary.

Figure 5:
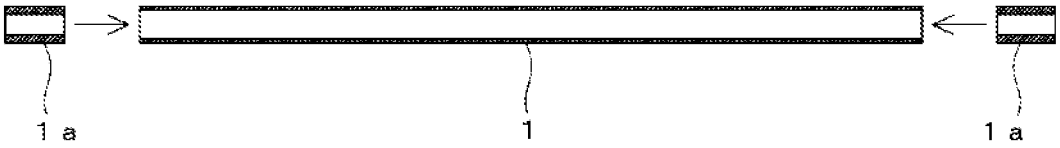
FIG. 5 is a schematic view similarly illustrating a second means.

FIG. 5 illustrates a second means for forming the press-fit portion 1*a* at the end of the ink containing tube 1. In the example illustrated in FIG. 5, the press-fit portions 1*a* formed as separate members are attached to both the ends of the ink containing tube 1, respectively, and this example adopts means for attaching the press-fit portion 1*a* using an adhesive.

In addition, thermal welding may enable to form the thick press-fit portions 1*a* to be substantially integrated with the ink containing tube 1 by attaching the press-fit portions 1*a* to both the ends of the ink containing tube 1 by thermal welding.

Figure 6:
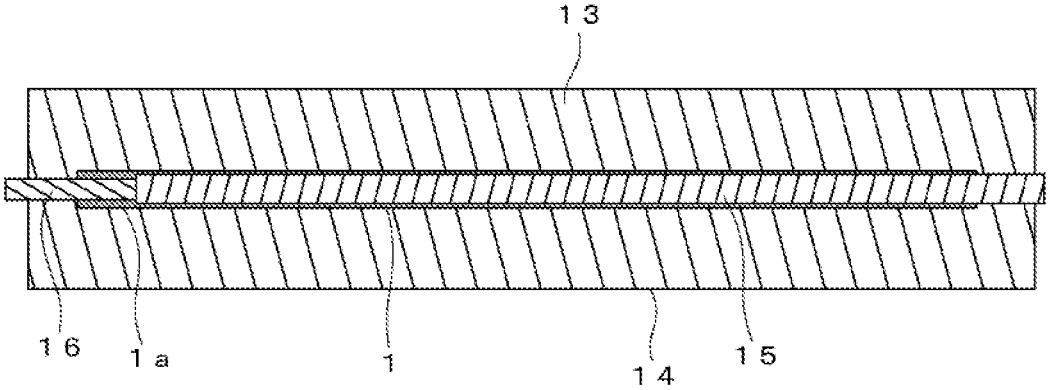
FIG. 6 is a schematic view similarly illustrating a third means.

FIG. 6 illustrates a third (A means for forming the press-fit portion 1*a* at the end of the ink containing tube 1. The example illustrated in FIG. 6 illustrates an example of molding which employs upper and lower split molds 13 and 14 and first and second core pins 15 and 16. That is, the ink containing tube 1 is formed with the upper and lower split molds 13 and 14 and the first core pin 15, and the thick press-fit portion 1*a* is formed with the upper and lower split molds 13 and 14 and the second core pin 16. In this case, the press-fit portion 1*a* can be molded integrally with the ink containing tube 1 at the same time.

The press-fit portion 1*a* is formed only on one end side of the ink containing tube 1 in the example shown in FIG. 6.

Figure 7:
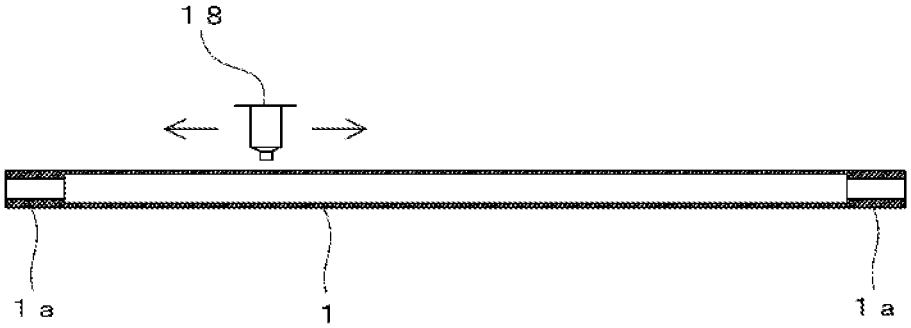
FIG. 7 is a schematic view similarly illustrating a fourth means.

FIG. 7 illustrates a fourth means for forming the press-fit portion 1*a* at the end of the ink containing tube 1. In the example illustrated in FIG. 7, a three-dimensional printer is used; as material (filaments) discharged from a reciprocating printer head 18 is stacked layer by layer and it is possible to integrally form the ink containing tube 1 and the press-fit portion 1*a* simultaneously.

Figure 8:
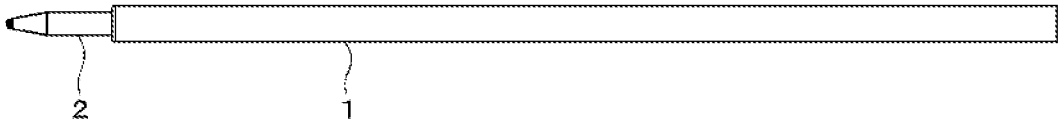
FIG. 8 is an external view illustrating a second aspect of the refill for a writing tool according to the present invention.
Figure 9:
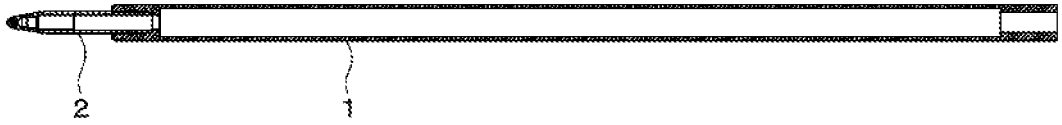
FIG. 9 is a central sectional view of the refill for the writing tool illustrated in FIG. 8.
Figure 10:
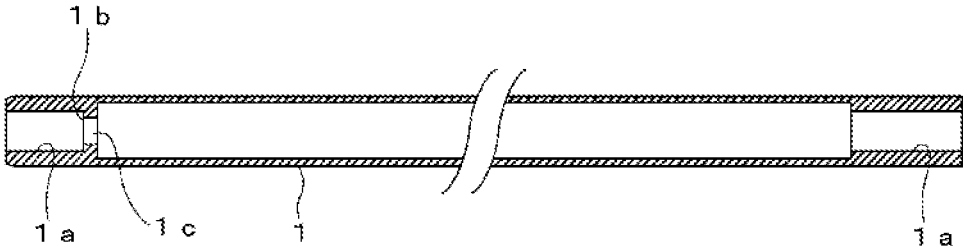
FIG. 10 is an enlarged central sectional view illustrating a configuration of an ink containing tube, as a single unit, to be used in the refill illustrated in FIG. 8.

FIGS. 8 to 10 illustrate a second aspect of the refill for a writing tool (ballpoint pen refill) according to the present invention. The ballpoint pen tip 2 is directly press-fitted and attached to a front end of the ink containing tube 1 without a relay member interposed therebetween in the ballpoint pen refill illustrated in FIGS. 8 to 10.

The ink containing tube 1 in the second aspect is also formed in a cylindrical shape to be flush in the axial direction. The press-fit portions 1*a* each of which is formed to be thickened toward an inner circumferential surface and has an opening hole penetrating in the axial direction are formed at both ends of the ink containing tube 1, respectively, as shown in FIG. 10.

In the second aspect, at the press-fit portion 1*a*, placed at the front end of the ink containing tube 1, to which the ballpoint pen tip 2 is to be attached, an abutment portion 1*b* having a shaft hole 1*c* is additionally formed closer to the central portion of the ink containing tube 1. The diameter of the shaft hole is smaller than the diameter of the opening hole forming the press-fit portion 1*a*.

Since the abutment portion 1*b* serves a positioning function as a stopper on which a rear end of the ballpoint pen tip 2 abuts, the ballpoint pen tip 2 formed in a tubular shape, as shown in FIG. 9, can be press-fitted to the press-fit portion 1*a* without forming a stepped portion, abutting on the end of the ink containing tube 1, on an outer peripheral surface of the ballpoint pen tip 2.

Also in the case of the ink containing tube 1 used for the ballpoint pen refill shown in FIGS. 8 to 10, it is possible to form the press-fit portion 1*a* and the abutment portion 1*b* at the end of the ink containing tube 1 by properly adopting the above described means shown in FIGS. 4 to 7.

Figure 11:
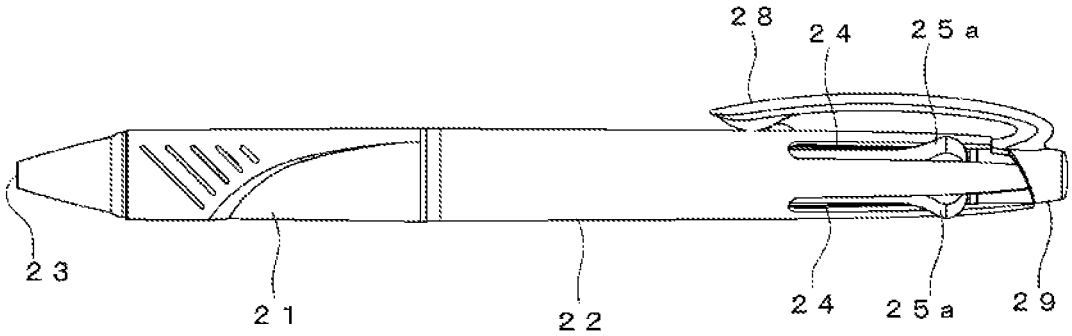
FIG. 11 is an external view illustrating a state where a refill for a writing tool according to the present invention is used in a composite writing tool.
Figure 12:
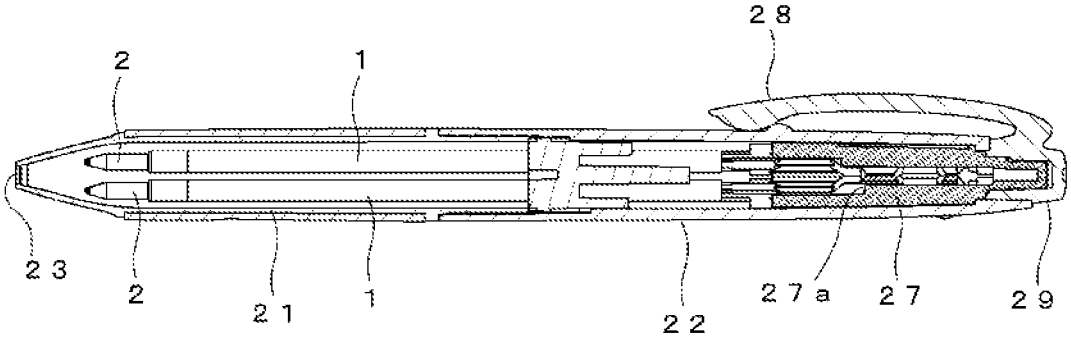
FIG. 12 is a central cross-sectional view of the composite writing tool illustrated in FIG. 11.
Figure 13:
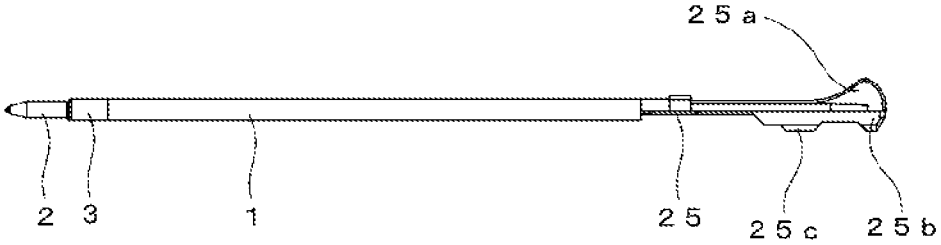
FIG. 13 is an enlarged external view illustrating a combined configuration of a slider employed in a composite writing tool and a refill for a writing tool.

FIGS. 11 to 13 illustrate an example in which the refill for a writing tool (ballpoint pen refill) according to the present invention is used in a composite multi-color ballpoint pen.

The composite multi-color ballpoint pen has an outer shell formed of a front shaft 21 and a rear shaft 22; a distal end of the front shaft 21 is reduced in diameter to form a conical shape and has a distal end opening 23. Further, it is configured such that the writing tip (ballpoint pen tip) 2 of one of the ballpoint pen refills is selectively fed out from the distal end opening 23.

A plurality of (four in this example) guiding slits 24 is formed at a rear end of the rear shaft 22 in the axial direction. An operating portion 25*a*, formed on a slider 25, is disposed in each of the guiding slits 24 so as to protrudes to the outside of the rear shaft and be slidable in the axial direction. Further, an inner tubular member 27 is accommodated in the rear shaft 22 in which the guiding slit 24 is formed, and a locking face 27*a*, for example, to lock the slider 25 in an advanced state is formed in the inner tubular member 27.

In addition, a rear end of the inner tubular member 27 is formed to have a slightly smaller diameter and protrudes from the rear end of the rear shaft 22. A cap member 29 integrally formed with a clip 28 is fittedly attached so as to cover such a protruding portion of the inner tubular member 27.

As illustrated in FIG. 13, a front end of the slider 25 is mounted and attached to the thick press-fit portion 1*a* that is formed at the rear end of the ink containing tube 1 (see FIGS. 2 and 3), and a return spring (not shown) is disposed so as to surround each of the ink containing tubes 1 and the corresponding slider 25. As a result, the respective ink containing tubes 1 and sliders 25 are disposed in a state of being biased toward the rear side in the axial direction of the composite multi-color ballpoint pen.

When any one of the sliders 25 is moved forward using the operating portion 25*a* in the above state, the operating portion 25*a* of the slider 25 moves forward along a groove formed in the inner tubular member 27 and falls down in a core axis direction. As a result, a rear end locking portion 25*b* of the slider 25 is locked to the locking face 27*a* formed in the inner tubular member 27. At this time, the refill attached to the slider 25 moderately bends due to its own flexibility, and the ballpoint pen tip 2 at the distal end of the refill is held in a protruded state from the distal end opening 23.

In addition, when another second slider 25 is moved forward in this state, a lock release cam 25*c* formed on the second slider 25 abuts on a pressed protrusion 25*b* of the first slider 25 that has been already locked in the advancing state and pushes the rear end locking portion 25*b* of the first slider 25 to the outside. As a result, the locking state of the first slider 25 is released.

As a result, the first slider 25 moves backward by action of the above-described return spring, and the rear end locking portion 25*b* of the second slider 25 is locked to the locking face 27*a* formed on the inner tubular member 27, thereby performing exchange of the ballpoint pen tip 2 fed out from the distal end opening 23.

As regards the refill for a writing tool and the writing tool according to the present invention as described above, since the tube thickness of the ink containing tube 1 can be made relatively thin except for the press-fit portion 1*a* at the end, it is possible to provide the refill for a writing tool ensuring a sufficient amount of ink stored without expanding the outer diameter of the ink containing tube.

Further, flexibility is imparted to the whole part of the refill for a writing tool by forming the thickness of the ink containing tube to be relatively thin; it is possible to guarantee a smooth protruding and retracting operation of each writing tip by utilizing the flexibility when this refill is used in the above-described composite writing tool.

Although the ballpoint pen refill is exemplified as the embodiment in the above description, the present invention can also be applied to a refill for a writing tool provided with a tip other than the ballpoint pen tip, and the same operational effects as described above can be obtained.

REFERENCE SIGNS LIST

1 ink containing tube
1*a* press-fit portion (opening hole)
1*b* abutment portion
1*c* shaft hole
2 writing tip (ballpoint pen tip)
3 joint member
11 welding tip
11*a* annular recess
11*b* gas inlet hole
13 upper split die
14 lower split die
15 first core pin
16 second core pin
18 printer head
21 front shaft
22 rear shaft
24 guiding slit
25 slider
25*a* operating portion

The invention claimed is:

1. A refill for a writing tool comprising:

an ink containing tube that is made from a resin material and formed in a straight cylindrical shape; and a writing tip which is attached to an end of the ink containing tube, wherein a press-fit portion, of which thickness is made thickened toward an inner circumferential surface and which has an opening hole penetrating therethrough in an axial direction at a central portion of the press-fit portion, is formed at the end of the ink containing tube, the writing tip or a relay member supporting the writing tip is press-fitted and attached to the press-fit portion, and the press-fit portion is formed at each of both ends of the ink containing tube.

2. The refill for a writing tool according to claim 1, wherein an abutment portion in which a shaft hole having a smaller diameter than the opening hole is bored is formed closer to the central portion of the ink containing tube in the press-fit portion.

3. A writing tool that contains the refill for a writing tool in a barrel, according to claim 1.

4. The refill for a writing tool according to claim 1, wherein the press-fit portion is integrally formed with the ink containing tube.

5. A writing tool that contains the refill for a writing tool in a barrel according to claim 4.

6. The refill for a writing tool according to claim 1, wherein an abutment portion in which a shaft hole having a smaller diameter than the opening hole is bored is formed closer to the central portion of the ink containing tube in the press-fit portion.

7. The refill for a writing tool according to claim 6, wherein the press-fit portion is integrally formed with the ink containing tube.

8. A writing tool that contains the refill for a writing tool in a barrel according to claim 6.

* * * * *